United States Patent [19]

Zelin

[11] Patent Number: 4,807,099

[45] Date of Patent: Feb. 21, 1989

[54] LIGHTING FIXTURES

[75] Inventor: Asher A. Zelin, Bronxville, N.Y.

[73] Assignee: ECP Energy Conservation Products, New York, N.Y.

[21] Appl. No.: 24,614

[22] Filed: Mar. 11, 1987

[51] Int. Cl.[4] ..... F21S 3/00

[52] U.S. Cl. ..... 362/225; 362/254; 362/296

[58] Field of Search ..... 362/225, 217, 260, 20, 362/222, 254, 296, 408

[56] References Cited

U.S. PATENT DOCUMENTS

| | | | |
|---|---|---|---|
| 2,505,112 | 4/1950 | Hallman | 362/260 |
| 3,185,835 | 5/1965 | Muller et al. | 362/225 |
| 3,375,361 | 3/1968 | Thompson et al. | 362/225 |
| 3,788,206 | 1/1974 | Mulvey | 362/260 |
| 4,246,629 | 1/1981 | Marrero | 362/225 |
| 4,363,083 | 12/1982 | Tanaka et al. | 362/294 |
| 4,520,436 | 5/1985 | McNair et al. | 362/225 |
| 4,595,969 | 6/1986 | McNair | 362/217 |

OTHER PUBLICATIONS

"Twist-of-the-Wrist"; Energy Conservation Products; 1983.

"Convert Your Hi-Hats with 3 Twist-of-the-Wrist® Retro-Fits from ECP"; includes 510 Series, 10 Series, Brilliant Beam; 1984.

*Primary Examiner*—Charles J. Myhre
*Assistant Examiner*—David A. Okonsky
*Attorney, Agent, or Firm*—Kuhn and Muller

[57] ABSTRACT

A fluorescent light fixture is provided which is suitable to be interchangeable with an incandescent lighting fixture recessed in a ceiling which includes a connector plug adapted to be inserted in a conventional incandescent lamp socket extending from a housing mounted on the fluorescent lamp activator housing having two horizontally disposed twin-tube type fluorescent lamps with a reflector between the lamp housing and the lamps which are configured and adapted to increase the lighting emitted from an open end of the lamp housing.

19 Claims, 3 Drawing Sheets

LIGHTING FIXTURES

FIELD OF THE INVENTION

The present invention relates to lighting fixtures and, more particularly, to improved fluorescent lighting fixtures with increased illumination which are adapted for recessed lighting installations and are suitable to retro-fit incandescent lighting fixtures.

BACKGROUND OF THE INVENTION

A great variety of different incandescent and fluorescent lighting fixtures are known and have been widely used commercially. The energy efficiency and economic advantages of fluorescent light systems have increased their commercial acceptance and, where possible, have led to their use in replacement of incandescent lighting installations. Heretofore, the differences in size, configuration, amount of illumination and electrical connection requirements between incandescent lighting fixtures and fluorescent lamps have made the interchangeability thereof substantially impossible without significant architectural and electrical changes being necessary; with the attendant increase in costs for making such changes. This is especially true when the incandescent lighting system already in place is recessed in the ceiling using fixtures such as those known as the "hi-hat" and the like type and similar amounts of illumination are needed or desired.

Accordingly, it would be highly desirable if fixtures were provided employing fluorescent lamps having increased illumination at low levels of electric power that were adaptable for use in existing incandescent lighting installations, particularly where such installations were recessed within ceilings and walls having the "hit-hat" type or the like type fixtures.

SUMMARY OF THE INVENTION

In accordance with the present invention there is provided lighting fixtures using fluorescent lamps which exhibit increased amounts of illumination without increasing the power requirements and are suitable for replacing recessed incandescent lighting fixtures. The novel lighting fixutres of the invention comprise: a connector stem means adapted for insertion in a conventional incandescent lamp socket; lamp housing means secured to said connector stem means; at least one twin tube-type fluorescent lamp mounted in said lamp housing; reflector means within said lamp housing adapted for increasing the light illumination of said fluorescent lamp from said lamp housing, prefereably without significantly increasing the heat within said lamp housing; and means for retaining said lamp fixture within a recessed cavity in a ceiling or wall.

It has been discovered that the light fixture of the invention is readily interchangeable with an incandescent light fixture in recessed lighting installations without the need for rewiring or remodeling of the installation structure. Moreover, the particular combination of fluorescent lamps and reflector in the fixture provides substantially the same amounts of illumination as would be produced by an incandescent bulb of substantially greater power requirements, resulting in a significant saving in energy. The surprising amount of illumination that can be provided by the particular combination of fluorescent lamps and reflector in the light fixtures of the invention makes the use thereof suitable for a variety of primary lighting installations including those which are recessed in walls and ceilings; substantially lower energy requirements than for incandescent lighting fixture of a similar size, configuration and amount of illumination.

Other advantages of the invention will become apparent from the following detailed description taken in conjunction with the accompanying drawing.

DESCRIPTION OF THE PREFERRED EMBODIMENTS

Figure 1:
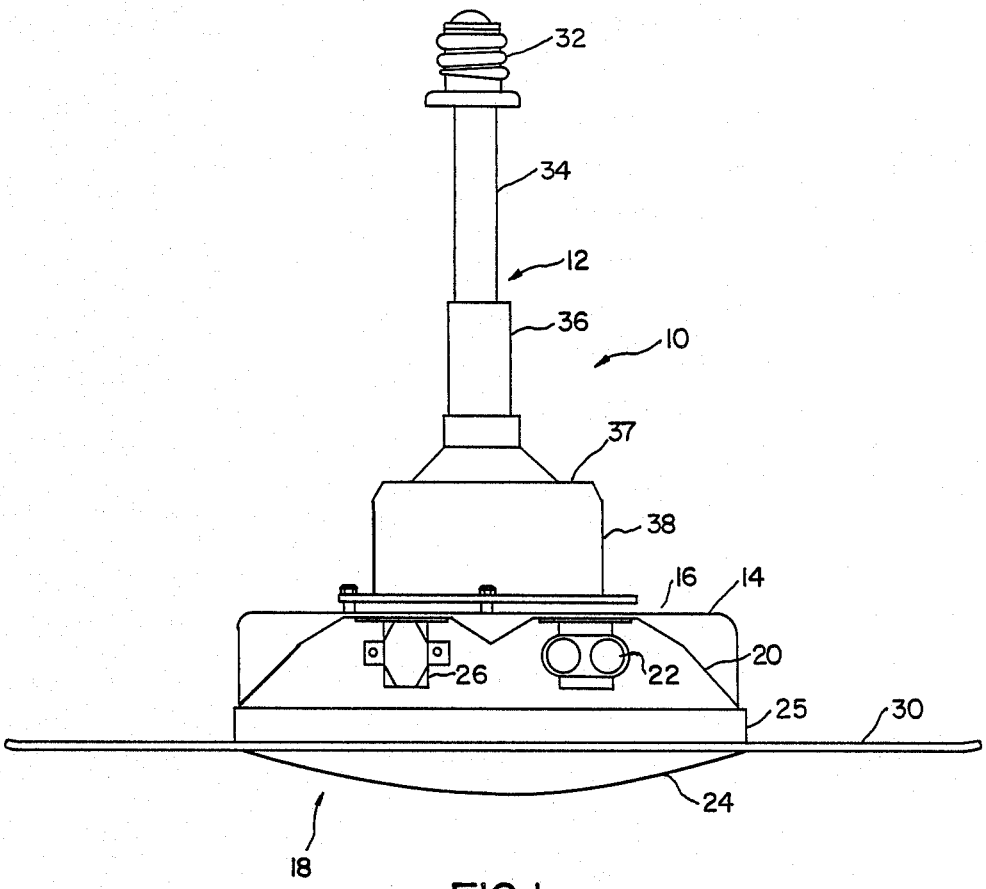
FIG. 1 is a side view, part in section of a lighting fixture in accordance with the invention.
Figure 2:
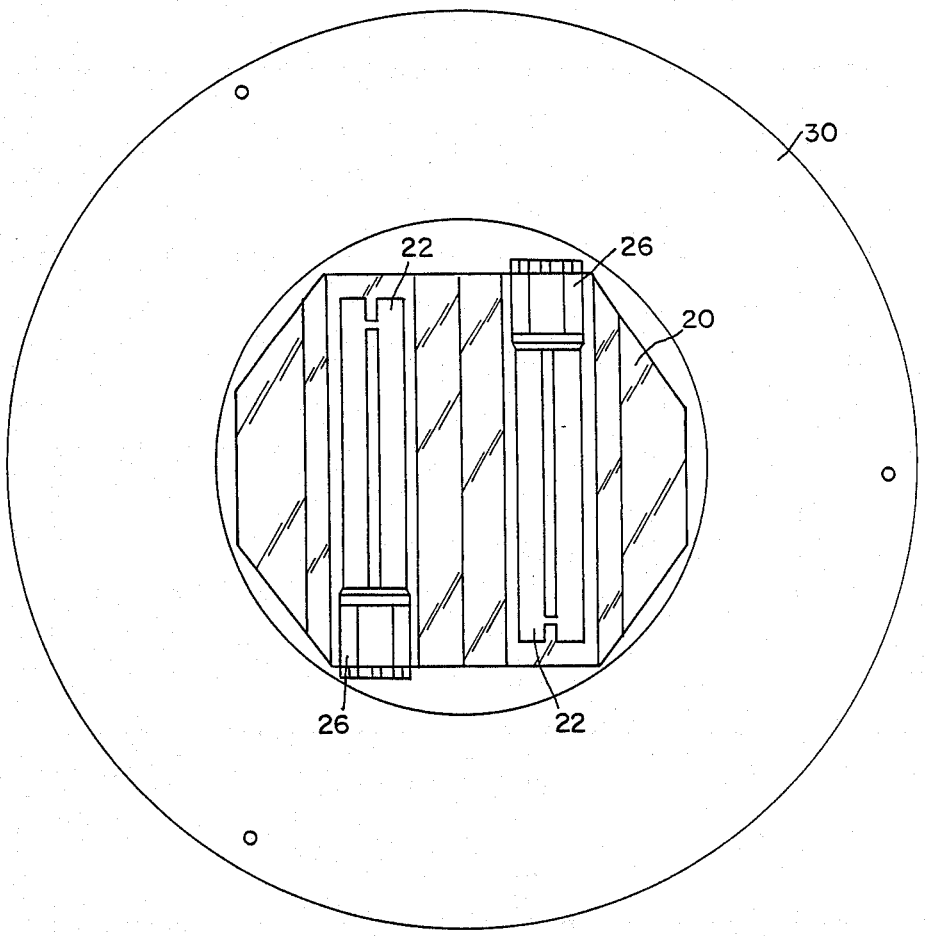
FIG. 2 is a bottom view of the lighting fixture of FIG. 1.

Referring now to the drawings where like reference numerals denote like parts, there is shown a fluorescent lamp fixture 10 which is adapted to be used in a recessed lighting installation originally designed for a "hi-hat" incandescent bulb lighting fixture.

The fixture 10 includes a spring loaded connector assembly 12, a lamp housing 14 mounted on the connector assembly 12, a diffuser lens cover 24 for the lamp housing 14 and a lip adapter 30 for the lamp housing to conform the same with ceiling surface.

Figure 3:
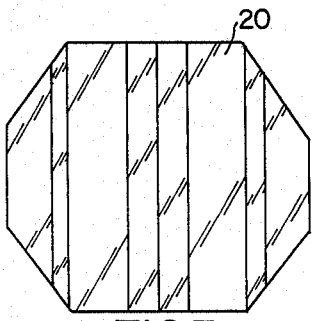
FIG. 3 is plan view of a reflector element of the lighting fixture of FIG. 1.
Figure 4:
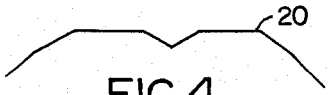
FIG. 4 is a side view of the reflector element of FIG. 3.

The lamp housing 14 has mounted on the top surface 16 of its generally circular hat type configuration two, spaced, horizontally disposed twin-tube fluorescent lamps 22. Each twin-tube lamp 22 is mounted at one end thereof in an electrical socket 26 which is fastened to the top surface 16 of the lamp housing 14 by screws or the like fastening means. Each socket 26 is connected to the connector assembly 12 by wires (not shown). A reflector 20 is mounted behind the two twin tube fluorescent lamps between the lamps 22 and the top surface 16 of the lamp housing 14 and secured to top surface 16 by screws or other conventional means. The reflector 20, which extends over substantially the entire top surface 16 of the lamp housing 14 and beyond each of the ends of the fluorescent lamp tubes 22 is configured as shown (FIGS. 3 and 4) to project a maximum amount of light emitted from the fluorescent lamps outwardly from the open end 18 of the lamp housing 14. The reflector 20 is made from a highly reflective, rigid material (approximately 0.025" thick) which is shaped in a conventional manner on a break press or any other shaping means known in the art. As would be evident, any reflector material such as a plated or coated metal, plastic or the like material which can be configured to project light emitted from the fluorescent lamps outward from the lamp housing would be suitable for use in accordance with the invention.

Mounted about the periphery of the open end 18 of the lamp hosuoing 14 is a lip adapter 30 which served to conform the fixture 10 to the ceiling in which it would be installed. The lip adapter 30 is fabricated with the lamp housing 14 in the embodiment shown but it can be separately fabricated and secured to the lamp housing 14 by any conventional means, if desired. A removable diffuser lens cover 24 is mounted over the open end 18 of lamp housing 14 by means of an adapter ring 25.

Figure 5:
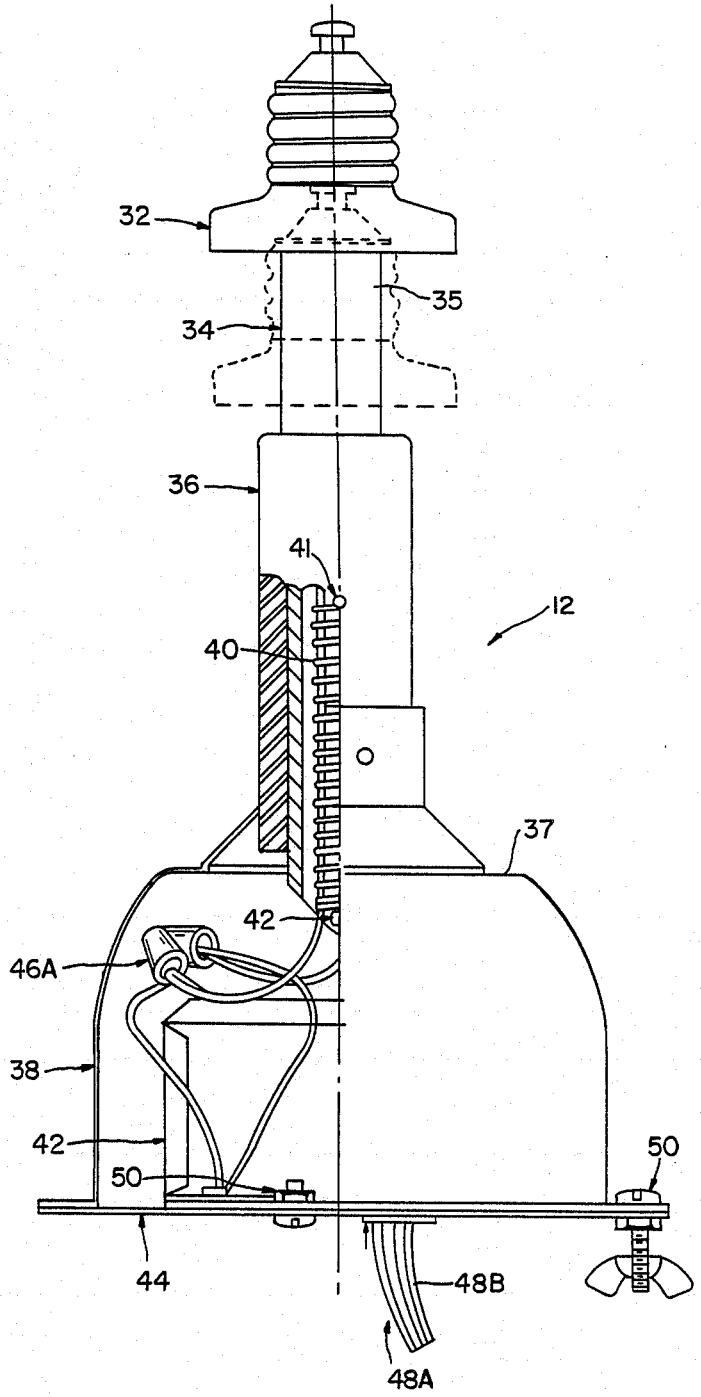
FIG. 5 is a side view, part in section, of a connector assembly of a lighting fixture in accordance with the invention.

As shown in FIG. 5, a spring loaded connector assembly 12 is employed to connect the fixture 10 into an existing recessed "hi-hat" type installation provided for an incandescent lighting fixture. The connector assembly 12 includes a screw in connector 32 which is secured by a threaded connector to the outwardly extending end 35 of a tube 34 which is reciprocally mounted within an outer tube 36. Outer tube 36 extends outwardly from the base bottom end 37 of a ballast cup 38. A compression coil spring 40 is disposed within tube 34 and retained at its opposing ends by steel pins 41 and 42. The spring biased, inner tube 34 permits the fixture stem length to self adjust for variations in fixture sizes.

Two conventional fluorescent lamp ballasts 42 are secured to a ballast cup mounting plate 44 which is mounted over the open, top end of the ballast cup 38. Wire connectors 46A, 46B communicate with and connect the ballasts 42 with the connector 32. Wire connectors 48A and 48B provide electrical communications between the ballasts 42 and the fluorescent tube socket mounted in the lamp housing 14. The lamp housing 14 is assembled to connector assembly 12 by fastening between the top surface 16 of the lamp housing 14 and the top end of the ballast cup 38 using screws 50 or similar conventional fastening means.

As will be apparent to those skilled in the art, the fluorescent lighting fixture of the invention may be used as a lighting means for recessed or flush mounted installations, may be direct wire-connected or used with a variety of conventional incandescent or fluorescent lamp installations and may be used to retro-fit a variety of different incandescent lighting systems. It will also be apparent to those skilled in the art that the surprising increase in illumination resulting from the particular combination of fluorescent lamps and reflectors of the invention make possible the use thereof in a variety of lighting applications with a significant reduction in energy being required in comparison to other types of lighting systems where the amount of illumination needed is of concern.

The principle, preferred embodiments and modes of operation of the present invention have been described in the foregoing specification. The invention is not to be construed as limited to the particular forms disclosed, since these are regarded as illustrative rather than restrictive and variations and changes may be made by those skilled in the art without departing from the spririt of the invention.

What is claimed is:

1. A fluorescent lamp lighting fixture which exhibits an increased amount of illumination which comprises:

(a) an elongatec connector stem means adapted for insertion in an incandescent lamp socket;

(b) lamp housing means mounted on said connector stem means;

(c) at least one twin-tube type fluorescent lamp bulb horizontally mounted in a socket at one end thereof within said lamp housing;

(d) a reflector assembly within said lamp housing means mounted between said lamp housing means and said fluorescent lamp bulb configured for increasing the light illumination of said fluorescent lamp from said lamp housing; and (e) electrical connector means within said connector stem means for activating said twin-tube type fluorescent lamp.

2. The fluorescent lamp lighting fixture according to claim 1, wherein said reflector assembly extends beyond the ends of said lamp bulb and substantially over the entire lamp housing means surface behind said fluorescent lamp.

3. The fluorescent lamp lighting fixture according to claim 1, wherein said electrical connector means for activating said twin-tube type fluorescent lamp bulb includes electrical communication means with said fluorescent lamp in said lamp housing means.

4. The fluorescent lamp lighting fixture according to claim 1, comprising means for retaining said lighting fixture within a recessed cavity in a ceiling.

5. The fluorescent lamp lighting fixture according to claim 4 wherein said lamp housing means is circular and includes a removable diffuser lens cover means for said lamp housing means and a lip adapted about said lamp housing means for conforming with said ceiling.

6. The fluorescent lamp lighting fixture according to claim 1, wherein two twin-tube type fluorescent lamps are horizontally disposed within said lamp housing with the socket for each lamp disposed in alternating arrangement and said reflector means extends beyond the ends of each of said lamps.

7. A fluorescent lamp lighting fixture which comprises:

(a) lamp housing means having a closed end upon which a twin-tube fluorescent lamp bulb can be horizontally mounted, an open end opposite said closed end and at least one wall extending therebetween;

(b) at least one twin-tube type fluorescent lamp bulb horizontally mounted in a socket at one end thereof within said lamp housing means;

(c) a reflector disposed within said lamp housing means between the closed end thereof and said fluorescent lamp bulb and configured about at least one side of said lamp bulb for increasing the light illumination of said fluorescent lamp bulb from the open end of said lamp housing means; and (d) electrical connector means including means for activating said fluorescent lamp disposed outside said lamp housing means having electrical communication means with said fluorescent lamp within said lamp housing means.

8. The fluorescent lamp lighting fixture according to claim 7, wherein said lamp housing means is of a circular hat-type configuration.

9. The fluorescent lamp lighting fixture according to claim 8, wherein said reflector has a generally trough-like configuration with a generally flat base thereof extending along the length of the tubular lamp bulb and lateral sides extending generally upwardly about opposite sides of said lamp bulb.

10. A fluorescent lamp lighting fixture suitable for use in recessed lighting installations;

(a) An elongated connector stem means adapted for connection with an electrical supply having a ballast housing mounted thereon with a fluorescent lamp ballast mounted within said ballast housing;

(b) a lamp housing mounted on said ballast housing;

(c) at least one twin tube type fluorescent lamp bulb horizontally mounted in a socket at one end thereof within said lamp housing;

(d) a reflector assembly mounted within said lamp housing between said lamp housing and said fluorescent lamp bulb, said reflector assembly being configured longitudinally about a portion of said lamp bulb for increasing the light illumination of said fluorescent lamp bulb from said lamp housing;

(e) means for retaining said lighting fixture within a recessed cavity in a ceiling; and (f) electrical connector means within said connector stem means for activating said twin-tube type fluorescent lamp.

11. The fluorescent lamp lighting fixture according to claim 10, wherein said connector stem means includes a threaded screw base connector for insertion in an incandescent lamp socket electricl supply source.

12. The fluorescent lamp lighting fixture according to claim 11, wherein said lamp housing is of a circular hat-type configuration with a closed end which is fastened to said ballast housing and on opposing open end from which light is emitted.

13. The fluorescent lamp lighting fixture according to claim 12, wherein said open end of lamp housing includes a lip adapted thereabout for conforming the lamp housing to the ceiling surface.

14. The fluorescent lamp lighting fixture according to claim 11, wherein said connector stem means comprises means for self-adjusting the length thereof.

15. The fluorescent lamp lighting fixture according to claim 12, wherein said reflector means extends over substantially the entire surface of the closed end of said lamp housing and beyond the ends of said fluorescent lamp.

16. The fluorescent lamp lighting fixture according to claim 15, wherein two twin-tube type fluorescent lamps are horizontally mounted within said lamp housing with the socket for each lamp being disposed in an alternating arrangement and said reflector extends beyond the ends of each of said lamps.

17. The fluorescent lamp lighting fixture according to claim 1, wherein said connector stem means includes a cylindrical tube.

18. The fluorescent lamp lighting fixture according to claim 17, wherein said cylindrical tube connector means includes two cylindrical tubes, one of which is reciprocally mounted within another cylindrical tube.

19. The fluorescent lamp lighting fixture according to claim 14, wherein said connector stem means includes two cylindrical tubes, one of which is reciprocally mounted within a second cylindrical tube, and wherein said threaded screw base connector is mounted on one end of said cylindrical tubes and said ballast housing is mounted on an end opposite the end of said cylindrical tubes to which the threaded screw base connector is mounted.

* * * * *